US007950898B2

(12) United States Patent
Kobayashi

(10) Patent No.: US 7,950,898 B2
(45) Date of Patent: May 31, 2011

(54) FUEL PUMP HAVING IMPELLER

(75) Inventor: Atsushige Kobayashi, Nagoya (JP)

(73) Assignee: Denso Corporation, Kariya (JP)

( * ) Notice: Subject to any disclaimer, the term of this patent is extended or adjusted under 35 U.S.C. 154(b) by 1051 days.

(21) Appl. No.: 11/798,381

(22) Filed: May 14, 2007

(65) Prior Publication Data

US 2007/0269307 A1 Nov. 22, 2007

(30) Foreign Application Priority Data

May 17, 2006 (JP) ..... 2006-137396

(51) Int. Cl.
*F04D 5/00* (2006.01)

(52) U.S. Cl. ..... 415/55.1

(58) Field of Classification Search ..... 415/55.1
See application file for complete search history.

(56) References Cited

U.S. PATENT DOCUMENTS 5,975,843 A * 11/1999 Ebihara ..... 415/119
6,497,552 B2 * 12/2002 Kobayashi et al. ..... 415/55.1
6,669,437 B2 * 12/2003 Yu et al. ..... 415/55.1
6,890,144 B2 * 5/2005 Yu et al. ..... 415/55.4
2003/0118438 A1 * 6/2003 Usui et al. ..... 415/55.1
2005/0163605 A1 7/2005 Oi

* cited by examiner

*Primary Examiner* — Ninh H Nguyen
*Assistant Examiner* — Ryan H Ellis
(74) *Attorney, Agent, or Firm* — Nixon & Vanderhye PC

(57) ABSTRACT

A fuel pump includes a housing including an internally-large cylindrical portion coaxial with an internally-small cylindrical portion. A press-inserted portion is press-inserted to the internally-small cylindrical portion. An accommodating cylindrical portion is located in the internally-large cylindrical portion. An accommodating disc portion is opposed to the impeller. A cover is in contact with the accommodating cylindrical portion on the opposite side of the accommodating disc portion. The accommodating disc portion has an impeller-side surface abutted to the accommodating cylindrical portion via an accommodating corner. The outer circumferential periphery of the press-inserted portion has an axial end defining a press-inserted corner on the side of the accommodating cylindrical portion. The accommodating corner is distant from the press-inserted corner for a first distance. The outer circumferential periphery of the press-inserted portion has an axially center portion being distant from the impeller-side surface for a second distance.

5 Claims, 3 Drawing Sheets

FUEL PUMP HAVING IMPELLER

CROSS REFERENCE TO RELATED APPLICATIONS

This application is based on and incorporates herein by reference Japanese Patent Application No. 2006-137396 filed on May 17, 2006.

FIELD OF THE INVENTION

The present invention relates to a fuel pump having a impeller.

BACKGROUND OF THE INVENTION

For example, U.S. 2005/0163605 A1 (JP-A-2005-207320) discloses a fuel pump including an impeller, a casing, and a housing. The casing accommodates the impeller, and defines a pump passage together with a cover. The housing is press-inserted with the casing. Fuel is pressurized through the pump passage with rotation of the impeller, so that the fuel is discharged from the fuel pump. The housing includes a large inner-diameter cylindrical portion and a small inner-diameter cylindrical portion being coaxially connected with each other. The small inner-diameter cylindrical portion has the inner diameter less than the inner diameter of the large inner-diameter cylindrical portion. The casing includes a press-inserted portion, an accommodating cylindrical portion, and an accommodating disc portion. The press-inserted portion is press-inserted to the inner circumferential periphery of the small inner-diameter cylindrical portion. The accommodating cylindrical portion is located in the large inner-diameter cylindrical portion, and is opposed to the outer circumferential periphery of the impeller. The accommodating disc portion is opposed to the bottom surface of the impeller on the side of the press-inserted portion.

In recent years, the impeller is jumboized in outer diameter, adapting to increase in flow rate of the fuel pump. It is requested to increase outer diameter of the impeller without increasing the outer diameter of the fuel pump. Therefore, the accommodating cylindrical portion of the casing is reduced in thickness with increase in outer diameter of the impeller. In this structure, when the press-inserted portion of the casing is press-inserted into the small diameter portion of the housing, a substantially center portion of the accommodating disc portion may by convexly deformed toward the impeller. Consequently, the casing and the impeller cannot define a predetermined clearance therebetween.

SUMMARY OF THE INVENTION

The present invention addresses the above disadvantage. According to one aspect of the present invention, a fuel pump includes an impeller rotatable for pumping fuel. The fuel pump further includes a housing including an internally-large cylindrical portion and an internally-small cylindrical portion being coaxially connected with each other. The internally-small cylindrical portion has a small inner diameter less than a large inner diameter of the internally-large cylindrical portion. The fuel pump further includes a casing including a press-inserted portion press-inserted to an inner periphery of the internally-small cylindrical portion. The casing further includes an accommodating cylindrical portion located in the internally-large cylindrical portion to be opposed to an outer circumferential periphery of the impeller. The casing further includes an accommodating disc portion being opposed to a bottom surface of the impeller on a side of the press-inserted portion. The fuel pump further includes a cover being in contact with an end surface of the accommodating cylindrical portion on an opposite side of the accommodating disc portion to surround the impeller on the opposite side of the accommodating disc portion. The accommodating disc portion has an impeller-side surface on a side of the impeller. The impeller-side surface and an inner periphery of the accommodating cylindrical portion define an accommodating corner therebetween. The press-inserted portion has an outer circumferential periphery having an axial end defining a press-inserted corner on a side of the accommodating cylindrical portion. The accommodating corner is distant from the press-inserted corner for a first distance equal to or greater than 0.5 mm and equal to or less than 1.5 mm. The outer circumferential periphery of the press-inserted portion has an axially center portion being distant from the impeller-side surface of the accommodating disc portion for a second distance equal to or greater than 1.3 mm and equal to or less than 2.3 mm.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

Figure 1:
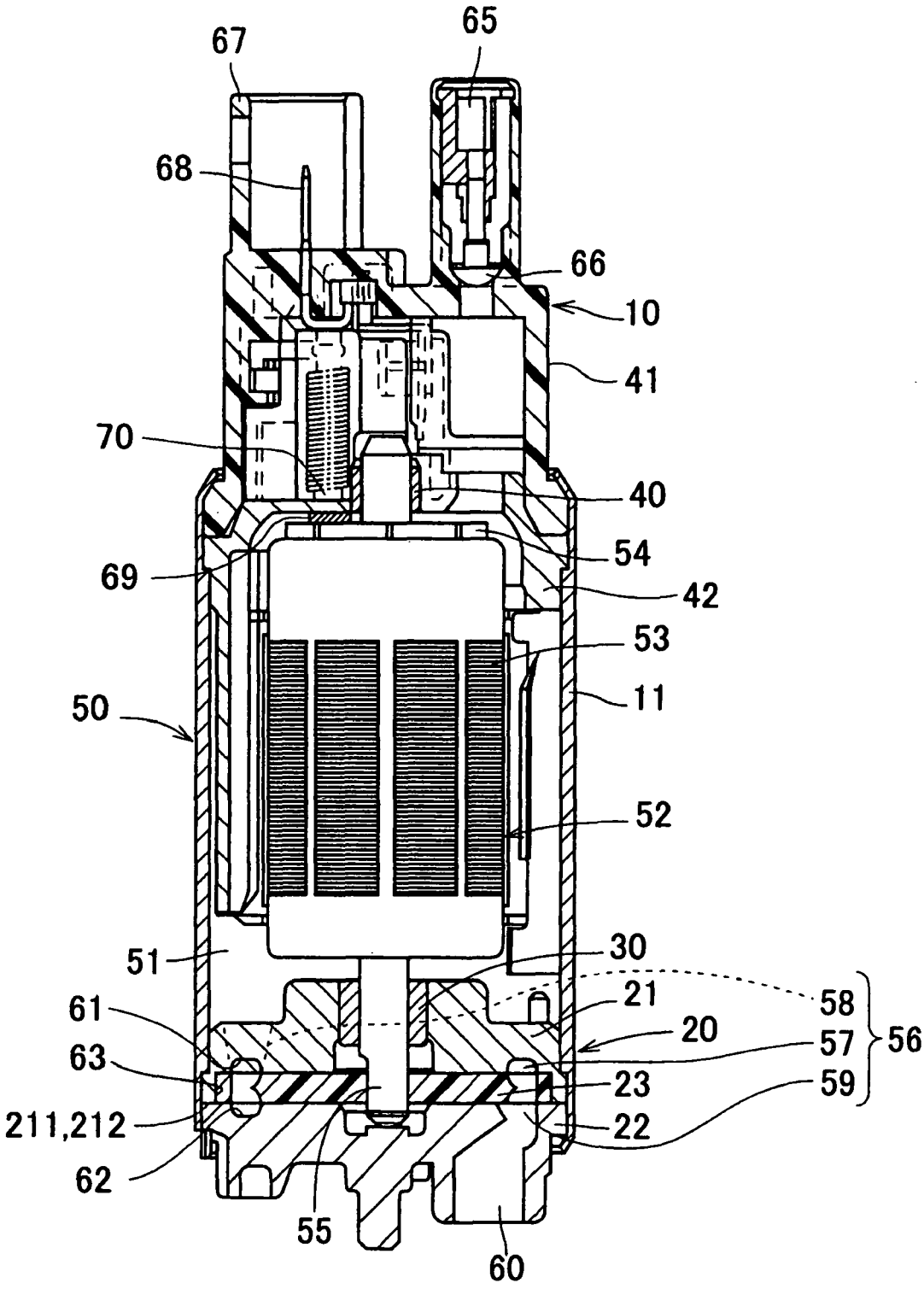
FIG. 1 is a sectional view showing a fuel pump.

A fuel pump 10 shown in FIG. 1 is accommodated in a fuel tank of a vehicle such as a two-wheel vehicle and a four-wheel (not shown) for pumping fuel from the fuel tank to an engine.

The fuel pump 10 is constructed of a pump portion 20 and a motor portion 50. The motor portion 50 serves as an electromagnetically driving portion for driving the pump portion 20. The motor portion 50 is a DC motor having a brush. The motor portion 50 includes a substantially cylindrical housing 11 accommodating annularly arranged permanent magnets. An armature 52 is provided around the inner circumferential periphery of the permanent magnet.

The pump portion 20 includes a casing 21, a cover 22, and an impeller 23. The casing 21 and the cover 22 construct a fuel passage member rotatably accommodating the impeller 23 serving as a rotor member. The casing 21 is stacked on the cover 22 via an end surface (collar surface) 211 of the casing 21 and an end surface of the cover 22. The stacked casing 21 and the cover 22 are fixed to an end of the housing 11 on the opposite side of the an end cover.

The impeller 23 has the outer circumferential periphery entirely provided with vanes. Adjacent vanes define a vane groove therebetween. The casing 21 and the cover 22 are formed of metal such as aluminum die-cast in this embodiment. The casing 21 has a center portion provided with a bearing 30. The bearing 30 rotatably supports one end of a rotation axis 55 of the armature 52. The rotation axis 55 has the other end rotatably supported by a bearing 40. The bearing 40 is supported in a center portion of a bearing holder 42 fixed to one end of the housing 11.

The casing 21 and the cover 22 therebetween define a pump passage 56 through which fuel flows. The pump passage 56 includes a pump passage 57, an outlet port 58, and an inlet port 59. The casing 21 defines the outlet port 58 through which fuel is discharged from the pump passage 57. The casing 21 has a substantially annular recession 63. The bottom surface of the recession 63 defines a substantially C-shaped groove 61. The cover 22 defines a substantially C-shaped groove 62. The inner peripheries the grooves 61, 62 and the impeller thereamong define the pump passage 57. The casing 21 defines the outlet port 58. Fuel is pressurized through the pump passage 57, and the pressurized fuel is discharged from the outlet port 58 into a fuel chamber 51.

The motor portion 50 rotatably accommodates the armature 52. A coil is wound round an outer periphery of the core 53. A substantially disc-shaped commutator 54 is provided to an upper portion of the armature 52. A terminal 68 is embedded in a connector housing 67. A power source (not shown) supplies electricity to the coil via the terminal 68, a brush 69, and the commutator 54. A choke coil 70 negates spark voltage.

The armature 52 rotates by being supplied with electricity, so that the impeller 23 rotates together with the rotation axis 55 of the armature 52. The impeller 23 rotates to pump fuel from a fuel inlet 60 of the cover 22 into the pump passage 56. Each vane of the impeller 23 applies kinetic energy to the fuel, thereby discharging the fuel from the pump passage 56 into the fuel chamber 51. The fuel discharged into the fuel chamber 51 passes around the armature 52, so that the fuel is discharged out of the fuel pump 10 through a discharge port 65. The discharge port 65 accommodates a check valve 66 for restricting counterflow of fuel trough the discharge port 65.

In this structure of the fuel pump 10, the coil of the armature 52 is supplied with electricity, so that the armature 52 is rotated. The impeller 23, which is fixed to the rotation axis 55 of the armature 52 rotates together with the rotation of the armature 52. The impeller 23 rotates, so that fuel is drawn from the fuel tank sequentially into the fuel inlet 60 and the inlet port 59 after passing through an unillustrated suction filter. The drawn fuel passes from the inlet port 59 toward the outlet port 58 through the pump passage 57. The vane grooves of the impeller 23 pressurize fuel passing through the pump passage 57. The pressurized fuel is introduced from the outlet port 58 into the fuel chamber 51, and the fuel passes from the outlet port 58 toward the discharge port 65 through the fuel chamber 51. Thus, the fuel is discharged from the discharge port 65 to the engine.

Figure 2:
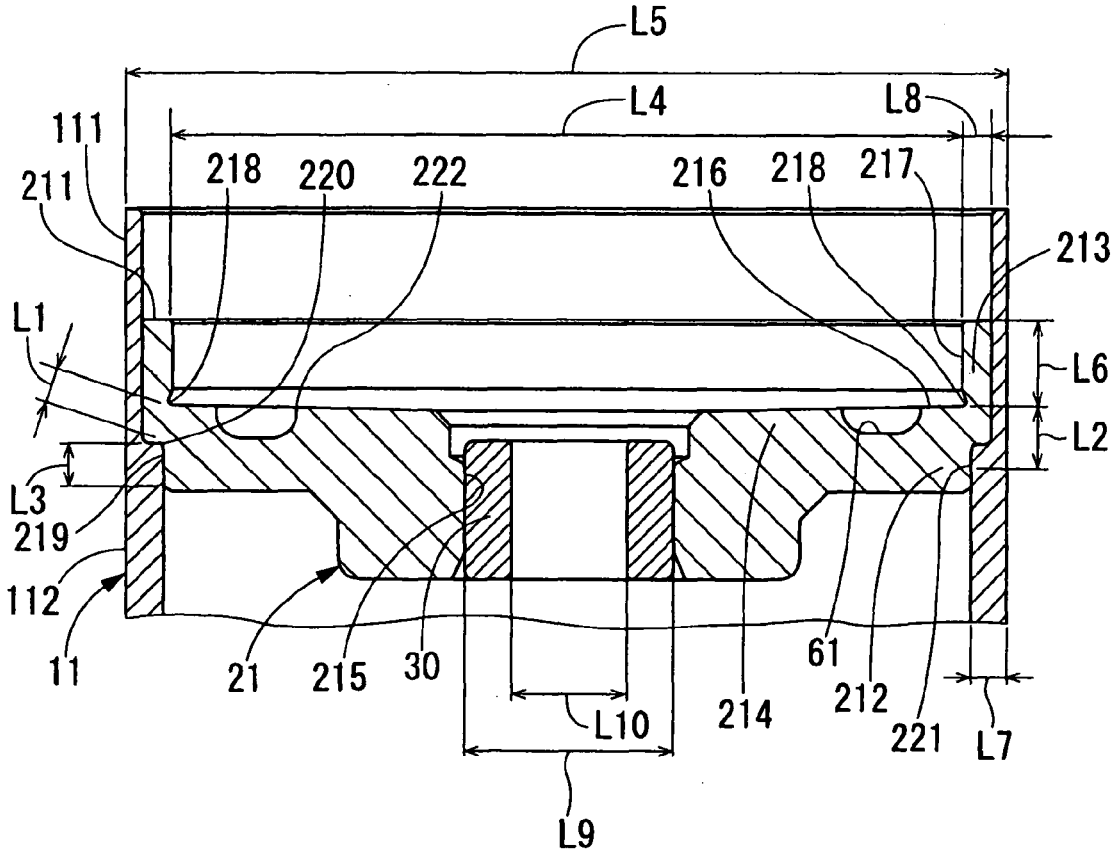
FIG. 2 is a sectional view showing a housing and a casing of the fuel pump.

Next, the construction of the housing 11 and the casing 21 is described with reference to FIG. 2. FIG. 2 depicts a condition where the cover 22, the impeller 23, and the rotation axis 55 are detached from the fuel pump 10.

The housing 11 is formed of metal to be in a substantially cylindrical member being axially elongated. The housing 11 includes a large inner-diameter cylindrical portion (internally-large cylindrical portion) 111 and a small inner-diameter cylindrical portion (internally-small cylindrical portion) 112 being coaxially connected with each other to accommodate the casing 21. The small inner-diameter cylindrical portion 112 has the inner diameter (small inner diameter) less than the inner diameter (large inner diameter) of the large inner-diameter cylindrical portion 111. The large inner-diameter cylindrical portion 111 and the small inner-diameter cylindrical portion 112 of the housing 11 has the same outer diameter L5. Therefore, the thickness of the large inner-diameter cylindrical portion 111 is less than the thickness of the small inner-diameter cylindrical portion 112.

The casing 21 is formed of, for example, aluminum. The casing 21 includes a press-inserted portion 212, an accommodating cylindrical portion 213, and an accommodating disc portion 214. The press-inserted portion 212, the accommodating cylindrical portion 213, and the accommodating disc portion 214 are integrally formed by die-casting.

The press-inserted portion 212 is a substantially cylindrical member being press-inserted into the inner circumferential periphery of the small inner-diameter cylindrical portion 112 of the housing 11. When the press-inserted portion 212 is press-inserted into the small inner-diameter cylindrical portion 112, the collar surface 211 of the accommodating cylindrical portion 213 is axially pressed toward the small inner-diameter cylindrical portion 112 using a tool.

The accommodating cylindrical portion 213 is a substantially cylindrical member located in the large inner-diameter cylindrical portion 111 of the housing 11. The inner circumferential periphery of the accommodating cylindrical portion 213 is opposed to the outer circumferential periphery of the impeller 23.

The accommodating disc portion 214 is a substantially disc-shaped member opposed to the bottom surface of the impeller 23 on the side of the press-inserted portion 212. The accommodating disc portion 214 has a through hole 215 and the groove 61. The bearing 30 is press-fitted into the through hole 215. The groove 61 defines the pump passage 57. The accommodating disc portion 214 has a portion, which defines the through hole 215 therein, having the thickness greater than the thickness of a portion defining the groove 61 in the accommodating disc portion 214.

An impeller-side surface 216 of the accommodating disc portion 214 and an inner circumferential periphery 217 of the accommodating cylindrical portion 213 define an accommodating corner portion 218 therebetween.

That is, the impeller-side surface 216 of the accommodating disc portion 214 is abutted to the inner circumferential periphery 217 of the accommodating cylindrical portion 213 via the accommodating corner portion 218.

The end of an outer circumferential periphery 219 of the press-inserted portion 212 defines a press-inserted corner portion 220 axially on the side of the accommodating cylindrical portion 213. The accommodating corner portion 218 is distant from the press-inserted corner portion 220 for a distance (first distance) L1. The distance L1 is equal to or greater than 0.5 mm and equal to or less than 1.5 mm.

The outer circumferential periphery 219 of the press-inserted portion 212 has a press-inserted center portion (axially center portion) 221, which is axially distant from the impeller-side surface 216 of the accommodating disc portion 214 for a distance (second distance) L2. The distance L2 is equal to or greater than 1.3 mm and equal to or less than 2.3 mm.

The axial length L3 of the press-inserted portion 212 is equal to or greater than 2 mm and equal to or less than 2.5 mm. The press-inserted portion 212 has a press-inserted margin relative to the small inner-diameter cylindrical portion 112. The press-inserted margin of the press-inserted portion 212 is equal to or greater than 20 μm and equal to or less than 70 μm. The inner diameter L4 of the accommodating cylindrical portion 213 is equal to or greater than 32 mm and equal to or less than 35 mm. The outer diameter L5 of the housing 11 is equal to or greater than 35 mm and equal to or less than 40 mm. The depth L6 of the accommodating cylindrical portion 213 is equal to or greater than 3.6 mm and equal to or less than 4 mm. The thickness L7 of the housing 11 is substantially 1.6 mm. The thickness L8 of the accommodating cylindrical portion 213 is equal to or greater than 1 mm and equal to or less than 2 mm. The inner diameter L9 of the through hole 215 is substantially 9 mm. The outer diameter L10 of the rotation axis 55 is substantially 5 mm.

Figure 3:
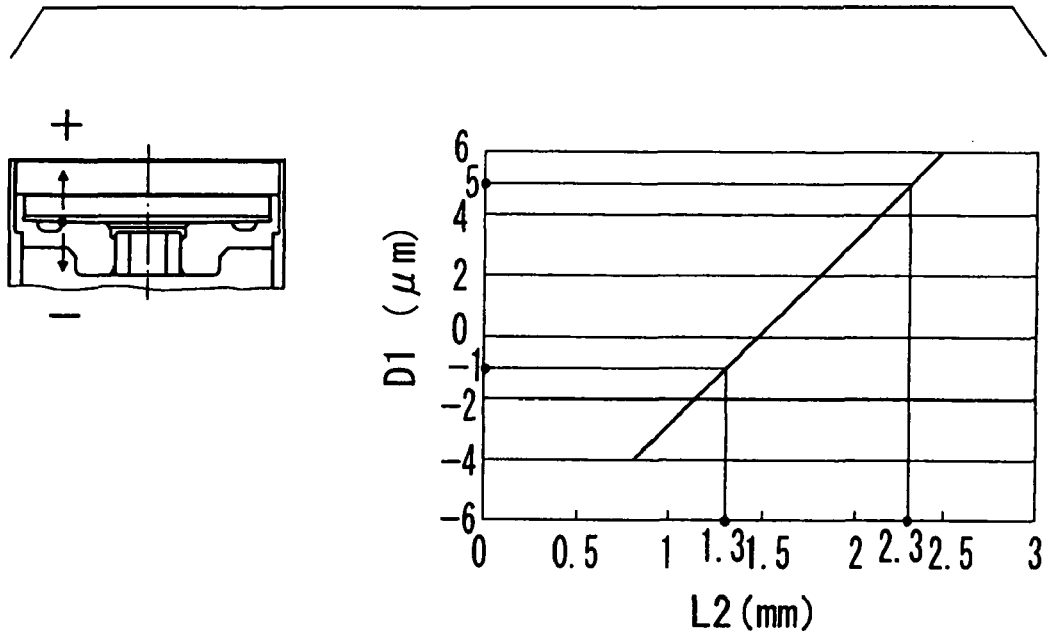
FIG. 3 is a graph showing a relationship between bending deformation (convex and concave deformation) D1 and a distance L2, for which a press-inserted center portion of the casing is distant from an impeller opposed surface of an accommodating disc portion.

In this structure, the distance L2 between the press-inserted center portion 221 and the impeller-side surface 216 of the accommodating disc portion 214 is equal to or greater than 1.3 mm and equal to or less than 2.3 mm. As shown in FIG. 3, in this structure, bending deformation (convex deformation) D1 of the casing 21 can be regulated to be equal or less than substantially 5 μm. In addition, bending deformation (concave deformation) D1 of the casing 21 can be regulated to be equal or less than substantially 1 μm (−1 μm in FIG. 3). FIG. 3 depicts the bending deformation of the accommodating disc portion 214 when the press-inserted portion 212 is press-inserted into the small inner-diameter cylindrical portion 112. The bending deformation D1 indicates deformation caused in the inner circumferential end 222 (FIG. 2) of the groove 61 of the accommodating disc portion 214.

The thickness L8 of the accommodating cylindrical portion 213 may be reduced for downsizing the fuel pump 10 in outer diameter L5 and for adapting to jumboizing the impeller 23 in outer diameter. Even in this structure, in which the thickness L8 of the accommodating cylindrical portion 213 is reduced, the bending deformation (convex deformation and concave deformation) D1 of the accommodating disc portion 214 can be possibly regulated. Thus, an amount of fuel leaking from the groove 61 to the outside can be possibly regulated. Thus, the discharge amount of the fuel pump 10 can be enhanced by enlarging the outer diameter of the impeller 23, in addition to reduction in outer diameter L5 of the fuel pump 10.

Referring to FIG. 3, the upper limit 2.3 mm of the distance L2 is set at a convex deformation allowable value such that the bending deformation (convex deformation) D1 is regulated to be equal to or less than 5 μm. The lower limit 1.3 mm of the distance L2 is set at a concave deformation allowable value such that the bending deformation (concave deformation) D1 is regulated to be equal to or less than 1 μm. That is, the concave deformation allowable value is less than the convex deformation allowable value.

When the accommodating disc portion 214 is convexly deformed, the impeller 23 is axially displaced to the opposite side of the accommodating disc portion 214 as the convex deformation becomes large. In this condition, the clearance between the impeller 23 and the casing 21 can be easily obtained by measuring the height of a step between the impeller 23 and the collar surface 211 of the casing 21 after press-inserting the casing 21.

When the accommodating disc portion 214 is concavely deformed, the axial position of the impeller 23 is determined in accordance with the location in which the accommodating corner portion 218 of the casing 21 is in contact with the impeller 23, regardless of the magnitude of the concave deformation of the accommodating disc portion 214. Accordingly, it is difficult to obtain the increase in clearance between the impeller 23 and the casing 21 due to the concave deformation. Therefore, it is difficult to evaluate whether the assembly of the impeller 23 and the casing 21 is a defective product, even when the clearance becomes excessively large. By contrast, in this embodiment, the concave deformation allowable value is less than the convex deformation allowable value. Therefore, an unrecognized defective product can be restricted from being produced.

Figure 4:
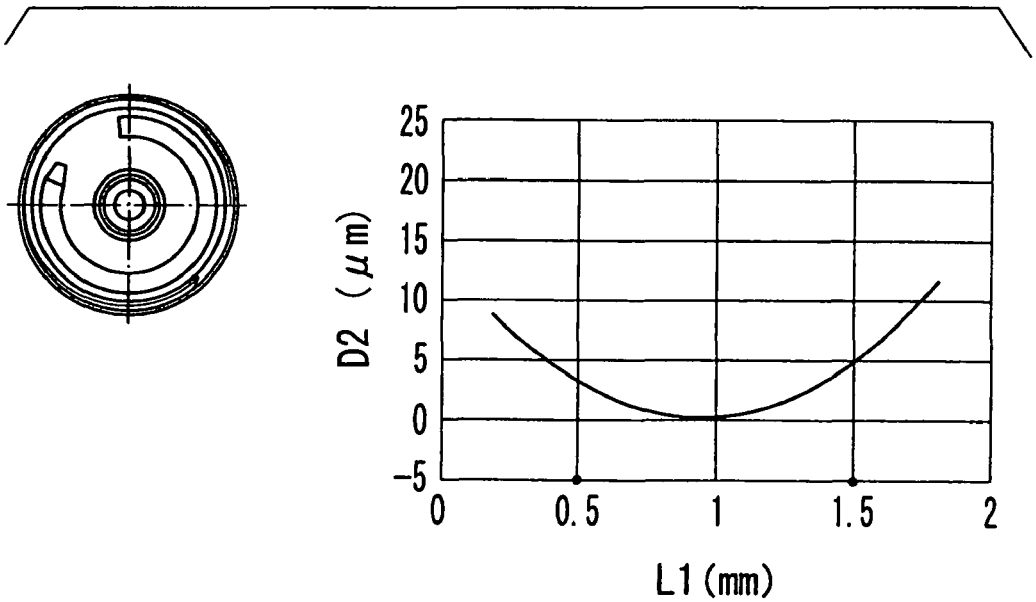
FIG. 4 is a graph showing a relationship between undulating deformation D2 and a distance L1, for which an accommodating corner portion of the casing is distant from a press-inserted corner portion of the casing.

Furthermore, in this embodiment, the distance L1 between the accommodating corner portion 218 and the press-inserted corner portion 220 is equal to or greater than 0.5 mm and is equal to or less than 1.5 mm. Therefore, as shown in FIG. 4, undulating deformation D2 of the collar surface 211 of the accommodating cylindrical portion 213 can be regulated to be equal to or less that 5 μm. The gap between the collar surface 211 of the accommodating cylindrical portion 213, which causes the undulating deformation, and the end surface of the cover 22 can be reduced. Thus, the discharging capacity of the fuel pump 10 can be maintained.

In this embodiment, the fuel pump 10 includes the impeller 23, the casing 21, which accommodates the impeller 23, and the housing 11, to which the casing 21 is press-inserted. The distance L1 between the accommodating corner portion 218 of the casing 21 and the press-inserted corner portion 220 is equal to or greater than 0.5 mm and equal to or less than 1.5 mm. The distance L2 between the press-inserted center portion 221 of the outer circumferential periphery 219 of the press-inserted portion 212 of the casing 21 and the surface 216 of the accommodating disc portion 214 on the side of the impeller 23 is equal to or greater than 1.3 mm and equal to or less than 2.3 mm.

First, an effect produced by defining the distance L2 between the press-inserted center portion 221 and the surface 216 of the accommodating disc portion 214 to be equal to or greater than 1.3 mm and equal to or less than 2.3 mm is described as follows.

When the press-inserted portion 212 is press-inserted into the small inner-diameter cylindrical portion 112, the convex deformation of the accommodating disc portion 214 becomes large with increase in moment calculated by multiplying radial force applied to the press-inserted portion 212 by the distance L2. In this embodiment, the distance L2 is defined to be equal to or less than 2.3 mm, so that the convex deformation D1 can be regulated to be equal to or less than 5 μm. Therefore, a predetermined clearance can be defined between the casing 21 and the impeller 23, so that a defective product can be restricted from being produced.

Furthermore, when the distance L2 is less than a predetermined value such as 1.5 mm, the accommodating disc portion 214 causes the concave deformation such that a substantially center portion of the accommodating disc portion 214 becomes distant from the impeller 23. When the accommodating disc portion 214 causes the concave deformation, fuel being pumped through the pump passage 56 may leak, and consequently, the fuel cannot be sufficiently pressurized. As a result, the discharge performance of the fuel pump 10 may be degraded. In this embodiment, the distance L2 is defined to be equal to or greater than 1.3 mm, so that the concave deformation D1 can be regulated to be equal to or less than 1 μm. Thus, the discharge performance of the fuel pump 10 can be maintained.

In this embodiment, the concave deformation allowable value is determined to be less than the convex deformation allowable value when the distance L2 is defined to be equal to or greater than 1.3 mm and equal to or less than 2.3 mm. The reason is described as follows.

When the accommodating disc portion 214 is convexly deformed, the impeller 23 is axially displaced to the opposite side of the accommodating disc portion 214 as the convex deformation becomes large. In this condition, the clearance between the impeller 23 and the casing 21 can be easily obtained by measuring the height of the step between the impeller 23 and the collar surface 211 of the casing 21 after press-inserting the casing 21.

When the accommodating disc portion 214 is concavely deformed, the axial position of the impeller 23 is determined in accordance with the location in which the accommodating corner portion 218 of the accommodating disc portion 214 is in contact with the impeller 23, regardless of the magnitude of the concave deformation of the accommodating disc portion 214. Accordingly, it is difficult to obtain the increase in clearance between the impeller 23 and the casing 21 due to the concave deformation. Therefore, it is difficult to evaluate whether the assembly of the impeller 23 and the casing 21 is a defective product, even when the clearance becomes excessively large.

Therefore, the upper limit 2.3 mm of the distance L2 is set at the convex deformation allowable value such that the convex deformation D1 is regulated to be equal to or less than 5 μm. The lower limit 1.3 mm of the distance L2 is set at the concave deformation allowable value such that the concave deformation D1 is regulated to be equal to or less than 1 μm. Thus, the concave deformation allowable value is determined to be less than the convex deformation allowable value.

Next, an effect produced by defining the distance L1 between the accommodating corner portion 218 of the casing 21 and the press-inserted corner portion 220 to be equal to or greater than 0.5 mm and equal to or less than 1.5 mm is described.

The undulating deformation D2 of the collar surface 211 of the accommodating cylindrical portion 213 of the casing 21 on the opposite side of the accommodating disc portion 214 becomes large with decreasing distance L1. The press-inserted portion 212 of the casing 21 is applied with force from the small inner-diameter cylindrical portion 112 of the housing 11 when being press-inserted. The force applied from the small inner-diameter cylindrical portion 112 exerts influence to the accommodating cylindrical portion 213. This influence becomes large with decreasing distance L1. Therefore, the undulating deformation D2 of the collar surface 211 of the accommodating cylindrical portion 213 becomes large with decreasing distance L1. As the distance L1 becomes large, the distance L2 between the press-inserted center portion 221 and the accommodating corner portion 218 correspondingly becomes large. Accordingly, the moment, which is calculated by multiplying radial force applied to the press-inserted portion 212 by the distance L2, also becomes large with increase in distance L2. Thus, the undulating deformation D2 of the collar surface 211 also becomes large with increase in distance L1.

In this embodiment, the distance L1 is defined to be equal to or greater than 0.5 and equal to or less than 1.5 mm, so that the undulating deformation D2 can be regulated to be equal to or less than 5 μm. Thus, the gap between the collar surface 211 of the accommodating cylindrical portion 213, which causes the undulating, deformation, and the cover 22 can be reduced, so that the discharging capacity of the fuel pump 10 can be maintained.

In this embodiment, the axial length L3 of the press-inserted portion 212 is equal to or greater than 2 mm and equal to or less than 2.5 mm, so that the casing 21 can be restricted from causing either the convex deformation or the concave deformation.

In this embodiment, the press-inserted margin of the press-inserted portion 212 relative to the small inner-diameter cylindrical portion 112 is equal to or greater than 20 μm and equal to or less than 70 μm, so that the casing 21 can be restricted from causing either the convex deformation or the concave deformation.

Other Embodiment

In this embodiment, the outer circumferential periphery of the press-inserted portion 212 of the casing 21 is entirely press-inserted. Alternatively, the outer circumferential periphery of the press-inserted portion 212 of the casing 21 may be partially press-inserted.

In this embodiment, the casing 21 is formed of aluminum. Alternatively, the casing 21 may be formed of metal other than aluminum. The casing 21 may be formed of resin.

Various modifications and alternations may be diversely made to the above embodiments without departing from the spirit of the present invention.

What is claimed is:

1. A fuel pump comprising:

an impeller rotatable for pumping fuel;

a housing including an internally-large cylindrical portion and an internally-small cylindrical portion being coaxially connected with each other, the internally-small cylindrical portion having a small inner diameter less than a large inner diameter of the internally-large cylindrical portion;

a casing including a press-inserted portion press-inserted to an inner periphery of the internally-small cylindrical portion, the casing further including an accommodating cylindrical portion located in the internally-large cylindrical portion to be opposed to an outer circumferential periphery of the impeller, the casing further including an accommodating disc portion being opposed to a bottom surface of the impeller on a side of the press-inserted portion; and a cover being in contact with an end surface of the accommodating cylindrical portion on an opposite side of the accommodating disc portion to surround the impeller on the opposite side of the accommodating disc portion, wherein the accommodating disc portion has an impeller-side surface on a side of the impeller, the impeller-side surface and an inner periphery of the accommodating cylindrical portion defining an accommodating corner therebetween, the press-inserted portion has an outer circumferential periphery having an axial end defining a press-inserted corner on a side of the accommodating cylindrical portion, the accommodating corner is distant from the press-inserted corner by a first distance (L1) equal to or greater than 0.5 mm and equal to or less than 1.5 mm, the outer circumferential periphery of the press-inserted portion has an axially center portion being distant from the impeller-side surface of the accommodating disc portion by a second distance (L2) equal to or greater than 1.3 mm and equal to or less than 2.3 mm, the accommodating corner is recessed outward in a radial direction beyond the inner periphery of the accommodating cylindrical portion, the outer circumferential periphery of the impeller is located on a radially outside of a vane groove of the impeller and a C-shaped groove of the cover, and a concave deformation allowable value of the accommodating disc portion is less than a convex deformation allowable value of the accommodating disc portion.

2. The fuel pump according to claim 1, wherein the press-inserted portion has an axial length equal to or greater than 2 mm and equal to or less than 2.5 mm.

3. The fuel pump according to claim 1, wherein the press-inserted portion has a press-inserted margin relative to the internally-small cylindrical portion, and the press-inserted margin is equal to or greater than 20 μm and equal to or less than 70 μm.

4. The fuel pump according to claim 1, wherein the accommodating cylindrical portion has an inner diameter equal to or greater than 32 mm and equal to or less than 35 mm.

5. The fuel pump according to claim 1, wherein the casing is formed of aluminum.

* * * * *